United States Patent [19]

Crates

[11] Patent Number: 4,945,461

[45] Date of Patent: Jul. 31, 1990

[54] PORTABLE WORK LIGHT WITH REPLACEABLE SCUFF GUARD

[75] Inventor: James M. Crates, Charlotte, N.C.

[73] Assignee: Jameson Corporation, Charlotte, N.C.

[21] Appl. No.: 354,797

[22] Filed: May 22, 1989

[51] Int. Cl.[5] ..... F21V 15/00

[52] U.S. Cl. ..... 362/378; 362/224; 362/310; 362/363; 362/376; 362/396

[58] Field of Search ..... 362/217, 224, 260, 307, 362/310, 363, 376, 378, 396, 400, 390

[56] References Cited

U.S. PATENT DOCUMENTS 3,808,495 4/1974 Win ..... 362/376 X 4,435,744 3/1984 Russo ..... 362/224 X

*Primary Examiner*—Stephen F. Husar

*Attorney, Agent, or Firm*—W. Thad Adams, III

[57] ABSTRACT

A portable work light including an elongate fluorescent bulb for emitting light when powered from an electrical current source, an elongate, transparent, relatively thick protective shield, a shock absorber within the shield mounting the bulb within the shield in spaced-apart relation thereto against breakage of the bulb from shock or impact. In addition, an elongate, transparent, relatively thin disposable scuff guard is positioned over the shield to protect the shield from scratching and scuffing and which can be replaced when scratched and scuffed to restore full light transmission to the work light.

14 Claims, 2 Drawing Sheets

PORTABLE WORK LIGHT WITH REPLACEABLE SCUFF GUARD

TECHNICAL FIELD AND BACKGROUND OF THE INVENTION

This invention relates to a portable work light with a replaceable scuff guard. Lights of the general type disclosed in this application are frequently used in garage's, construction projects and in many other environments where a portable light source is needed. Typically, the light according to the prior art includes a fluorescent bulb shock mounted and enclosed within a hard plastic, transparent protective tubular shield. The plastic, for example nylon, is relatively soft and easy to scratch. These lights are used in environments where scratching, scuffing and abrasion of the shield is common. In addition, nylon will discolor over time in response to exposure to sunlight and certain chemicals. Scuffing of the plastic shield can be so severe than the light transmitting efficiency of the light is substantially reduced. In prior art lights, the only remedy is to disassemble the light and replace the shield. The shield is a relatively expensive component with machined areas to receive end caps, O-rings and other components. The invention described in this application permits the shield to serve its function indefinitely by providing a relatively inexpensive, disposable scuff guard which can be replaced when scuffed to restore the light to full efficiency.

SUMMARY OF THE INVENTION

Therefore, it is an object of the invention to provide a replaceable scuff guard for a portable work light.

It is another object of the invention to provide a portable work light in which the light transmitting efficiency of the light can be maintained indefinitely at low cost.

These and other objects of the present invention are achieved in the preferred embodiments disclosed below by providing a portable work light, comprising an elongate bulb for emitting light when powered from an electrical current source, an elongate, transparent, relatively thick protective shield, a shock absorber within the shield mounting the bulb within the shield in spaced apart relation thereto against breakage of the bulb from shock or impact. In addition, an elongate, transparent, relatively thin disposable scuff guard is positioned over the shield to protect the shield from scratching and scuffing and which can be replaced when scratched and scuffed to restore full light transmission to the work light.

According to one preferred embodiment of the invention, the shield and the scuff guard are both circular in cross-section and define tubes.

According to another preferred embodiment of the invention, the shield and the scuff guard each define walls, and the shield wall is no less than five times as thick as the scuff guard wall.

Preferably, the scuff guard is sized to fit over the shield in close, sliding fit relation and the shield comprises nylon.

According to another preferred embodiment of the invention, the scuff guard comprises cellulose acetate butyrate.

According to yet another preferred embodiment of the invention, a reflective sheet is positioned intermediate the bulb and the shield for reflecting light from one side of the shield through the other side in order to shield the operator's eyes from the light and to direct the light in a desired direction.

According to yet another preferred embodiment of the invention, the bulb comprises a fluorescent bulb, and the light includes a fluorescent starter and an AC power connection.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
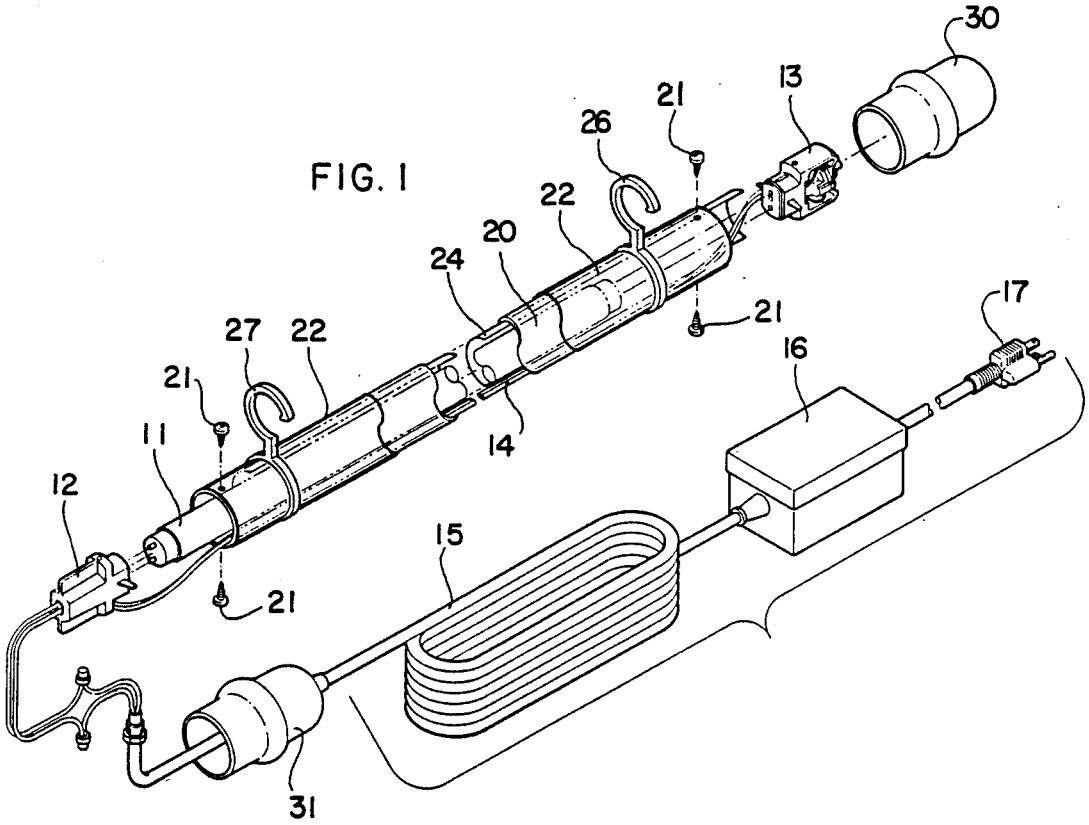
FIG. 1 is an exploded view of a portable light according to an embodiment of the invention.

Referring now specifically to the drawings, a portable light according to a preferred embodiment of the present invention is illustrated in FIG. 1 and shown generally at reference numeral 10. Other embodiments having various shock mountings and closure systems, and including one having a sealed, Halon-charged space between the bulb and the shield are not shown in this application. However, the replaceable scuff guard aspect in each case is the same.

Light 10 comprises an elongate fluorescent bulb 11 mounted in shock absorbing bulb supports 12 and 13 which include appropriate bulb sockets. Bulb supports 12 and 13 are connected by suitable wiring 14, which includes a length of power cord 15, a ballast 16 and a standard grounded AC plug 17.

The bulb 11 is mounted within a high strength, transparent nylon tubular shield 20, over which is mounted a relatively thin transparent cellulose acetate butyrate scuff guard 22 according to the present invention. See also FIG. 4. Shield 20 and scuff guard 22 are held in place by screws 21 which extend through respective screw holes and into bulb supports 12 and 13.

Preferably, the outside diameter of shield 20 is only about 0.04" less than the inside diameter of the scuff guard 22. Effectively, the scuff guard 22 will slide on and off the underlying shield 20 during assembly but otherwise fits closely against the outer surface of shield 20. Scuff guard 22 is approximately 0.8 mm thick in comparison with shield 20, which is approximately 8 mm thick or, in other words, about one-tenth the thickness of shield 20. Preferably, scuff guard 22 is UV stabilized, i.e., treated to filter out and withstand ultraviolet light. Damage from UV light to shield 20 is thereby minimized.

A Mylar reflective decal 24 is positioned between bulb 11 and shield 20 and reflects light away from one side of bulb 11 and though a side of bulb 11 comprising approximately 180 of the circumference of bulb 11.

Figure 2:
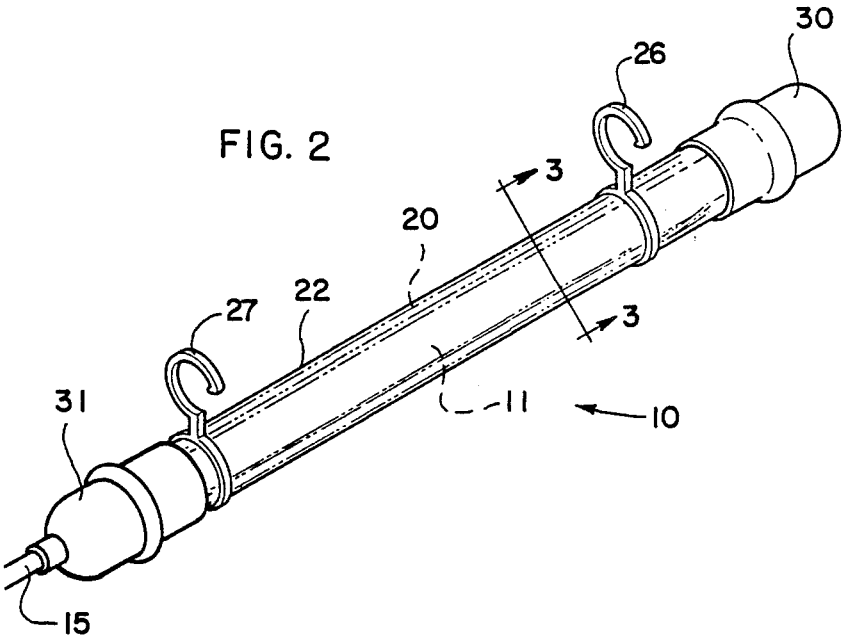
FIG. 2 is a perspective view of the light shown in FIG. 1.

A pair of plastic hangers 26 and 27 are positioned over scuff guard 22 and permit the light 10 to be suspended as necessary when in use. The ends of light 10 are enclosed by rubber or plastic shock-absorbing end caps 30, 31, as is best shown in FIG. 2.

Figure 3:
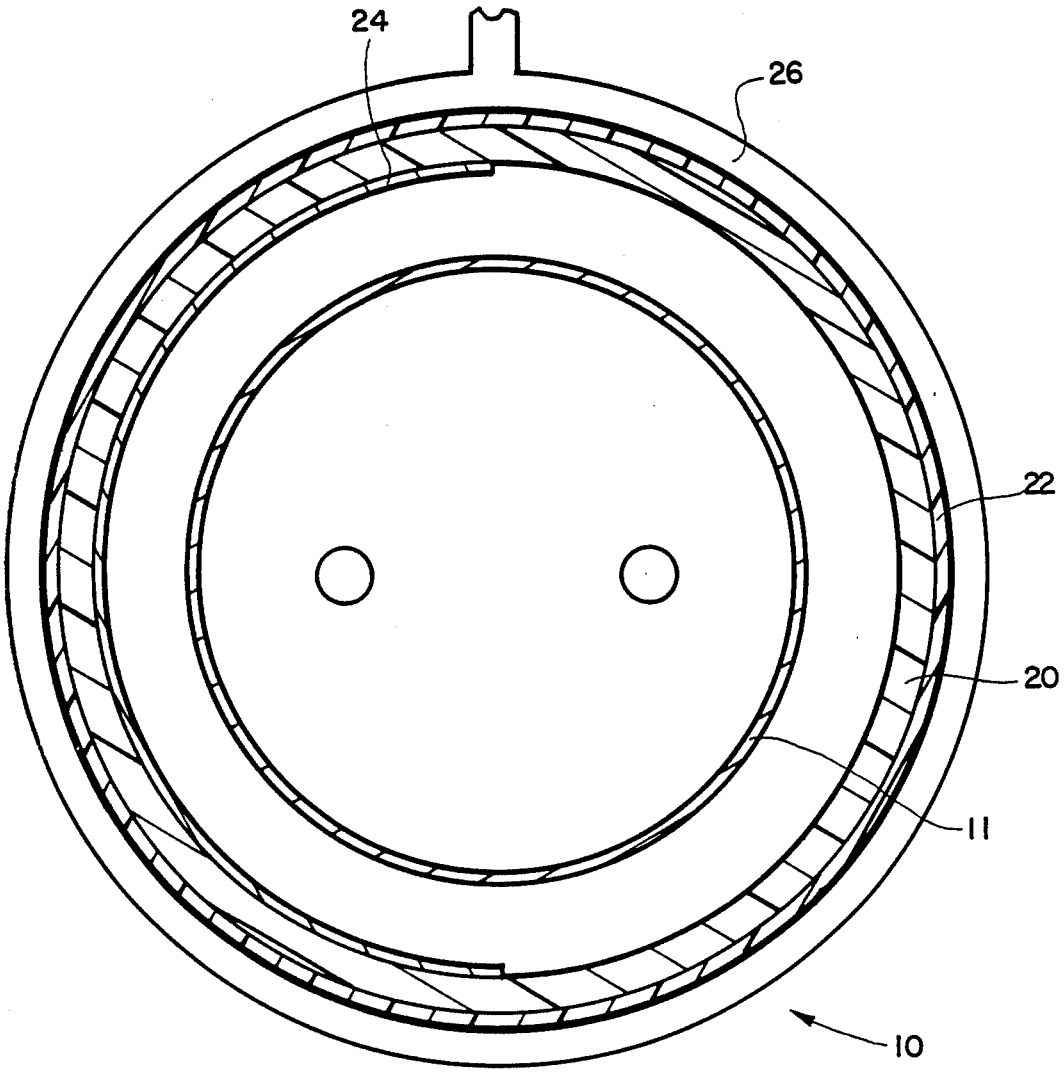
FIG. 3 is a cross-sectional view taken along lines 3—3 of FIG. 2.

The concentric arrangement described above is illustrated in FIG. 3.

Figure 4:
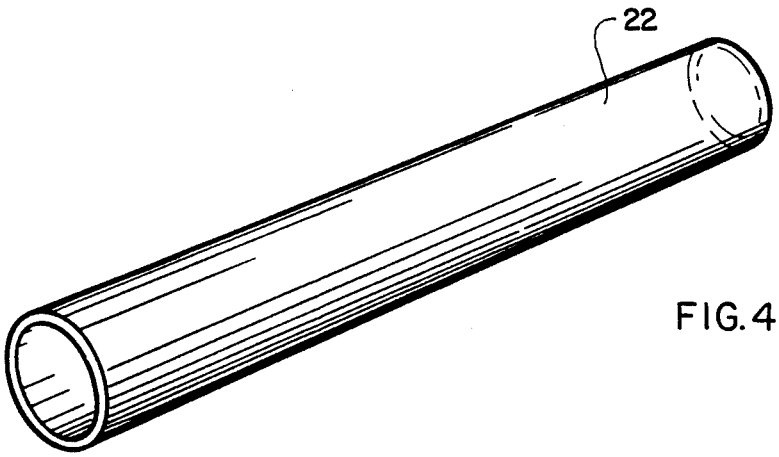
FIG. 4 is a perspective view of the scuff guard according to the embodiment of the invention shown in FIGS. 1–3.

According to the most efficient practice of the invention, scuff guard 22 is as thin and as inexpensive as is practical. As is shown in FIG. 4, scuff guard 22 has walls which are self supporting and therefore retains its tubular shape. It is therefore quite easy to remove a damaged scuff guard 22 and replace it with a new one. Since the scuff guard 22 prevents damage and wear to the underlying shield 20, shield 20 should never need replacement unless actually structurally damaged from a heavy blow. It is not intended that scuff guard 22 be thick or strong enough to provide any significant additional strength to light 10. Its only purpose is to prevent wear to the much thicker and more expensive shield 20.

For this reason, scuff guard could also comprise an oversized tube formed, for example, from a heat shrinkable, tough plastic sheet material which is pulled over shield 20 and then heat shrunk onto shield 20. Such a scuff guard would take its final shape from shield 20 and could be removed by carefully cutting the material adjacent one of the end caps and tearing the sheet off of the underlying shield 20.

Whatever the particular construction of the scuff guard, the central point is that the shield is protected from damage so that periodic replacement of the scuff guard restores the light to full light transmitting efficiency and a "like new" appearance.

A work light with a replaceable scuff guard is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A portable work light, comprising:

(a) an elongate bulb for emitting light when powered from an electrical current source;

(b) an elongate, transparent, relatively thick protective shield;

(c) shock absorbing means within said shield mounting said bulb within said shield in spaced-apart relation thereto against breakage of said bulb from shock or impact; and (d) an elongate, transparent, relatively thin disposable scuff guard positioned over said shield to protect said shield from scratching and scuffing and which can be replaced when scratched and scuffed to restore full light transmission to the work light.

2. A work light according to claim 1, wherein said shield and said scuff guard are both circular in cross-section and define tubes.

3. A work light according to claim 2, wherein said shield and said scuff guard each define walls, and wherein the shield wall is no less than five times as thick as the scuff guard wall.

4. A work light according to claim 2, wherein said scuff guard is sized to fit over said shield in close, sliding fit relation.

5. A work light according to claim 2, wherein said shield comprises nylon.

6. A work light according to claim 2, wherein said scuff guard comprises cellulose acetate butyrate.

7. A work light according to claim 1 and including a reflective sheet positioned intermediate said bulb and said shield for reflecting light from one side of said shield through the other side thereof.

8. A work light according to claim 1, wherein said bulb comprises a fluorescent bulb, and said light includes a fluorescent starter and an AC power connection.

9. A portable work light, comprising:

(a) a bulb for emitting light when powered from an electrical current source;

(b) a transparent, relatively thick protective shield;

(c) shock absorbing means within said shield mounting said bulb within said shield in spaced-apart relation thereto against breakage of said bulb from shock or impact; and (d) a transparent, relatively thin disposable scuff guard positioned over said shield to protect said shield from scratching and scuffing and which can be replaced when scratched and scuffed to restore full light transmission to the work light.

10. A work light according to claim 9, wherein said shield and said scuff guard each define walls, and wherein the shield wall is no less than five times as thick as the scuff guard wall.

11. A work light according to claim 9, wherein said scuff guard is sized to fit over said shield in close, sliding fit relation.

12. A work light according to claim 9, wherein said shield comprises nylon.

13. A work light according to claim 9, wherein said scuff guard comprises cellulose acetate butyrate.

14. A work light according to claim 9 and including a reflective sheet positioned intermediate said bulb and said shield for reflecting light from one side of said shield through the other side in order to shield the operator's eyes from the light and to direct the light in a desired direction.

* * * * *